US008096433B2

(12) United States Patent
Weiler et al.

(10) Patent No.: US 8,096,433 B2
(45) Date of Patent: Jan. 17, 2012

(54) HERMETICALLY SEALED CONTAINER

(75) Inventors: Gerhard H. Weiler, Woodstock, IL (US); Kathleen E. Kurek, Des Plaines, IL (US)

(73) Assignee: Weiler Engineering, Inc., Elgin, IL (US)

( * ) Notice: Subject to any disclaimer, the term of this patent is extended or adjusted under 35 U.S.C. 154(b) by 1015 days.

(21) Appl. No.: 11/825,267

(22) Filed: Jul. 5, 2007

(65) Prior Publication Data

US 2009/0008354 A1 Jan. 8, 2009

(51) Int. Cl.
*B65D 47/18* (2006.01)

(52) U.S. Cl. ..... 215/253; 222/541.6; 220/266; 215/249

(58) Field of Classification Search ..... 220/266; 215/253, 256, 249; 222/541.6, 541.9
See application file for complete search history.

(56) References Cited

U.S. PATENT DOCUMENTS 6,619,516 B2 * 9/2003 Weiler et al. ..... 222/420

* cited by examiner

*Primary Examiner* — Anthony Stashick
*Assistant Examiner* — James N Smalley
(74) *Attorney, Agent, or Firm* — Olson & Cepuritis, Ltd.

(57) ABSTRACT

A hermetically sealed thermoplastic container is equipped with a unitary closure that includes a draining spike access aperture occluded by a removable, twist-off cap and an internal draining spike stabilizer situated in the neck portion of the container.

8 Claims, 2 Drawing Sheets

HERMETICALLY SEALED CONTAINER

TECHNICAL FIELD OF THE INVENTION

This invention relates to hermetically sealed thermoplastic containers. More particularly, this invention is directed to a hermetically sealed container provided with an improved access port for a draining spike.

BACKGROUND OF THE INVENTION

Hermetically sealed containers that incorporate pierceable membranes that are to be pierced by a draining spike are known in the art and are illustrated by U.S. Pat. No. 4,901,873 to Weiler and U.S. Pat. No. 5,595,314 to Weiler. Such containers utilize a separately fabricated closure insert, and are useful in applications where the container contents is dispensed through a nozzle affixed to the container as the membrane is pierced or thereafter. U.S. Pat. No. 6,571,971 to Weiler illustrates a closure insert that provides a primary seal about a draining spike in the form of a peripheral sealing band or bead carried by a downwardly depending skirt portion downstream from the pierced membrane. The pierced membrane then serves as a partial secondary seal.

From the standpoint of cost and manufacturing expediency it would be desirable, however, to dispense with the need for a separately fabricated closure insert when making hermetically sealed thermoplastic containers, the content of which can be accessed utilizing a draining spike.

The fabrication of a seal such as that shown in the aforementioned U.S. Pat. No. 6,571,971 is not possible, however, when the container closure is not a separate insert but is unitary with an fabricated concurrently with the molding of the container itself.

SUMMARY OF THE INVENTION

The present invention provides a hermetically sealed thermoplastic container well suited for use with a draining spike for emptying the contents thereof. In particular, a thermoplastic container embodying the present invention has a body portion, a specially contoured neck portion unitary with the body portion, and a removable cap that provides a closure for the neck portion. The removable cap is unitary with the neck portion but is delineated therefrom by a frangible web.

The container neck portion terminates in a flexible enclosure that preferably is bell-shaped and defines a draining spike access aperture which is occluded by the removable cap. At least a portion of the flexible enclosure is inwardly collapsible. The draining spike access aperture is sized to form a liquid-tight seal with the draining spike upon entry and preferably is inwardly collapsible about the draining spike as it enters the container. A draining spike stabilizer is provided that is spaced from the spike access aperture and is substantially coaxial therewith.

A preferred draining spike stabilizer comprises a pair of opposed, inwardly extending flange segments adapted to receive the draining spike therebetween. Preferably the opposed flange segments contact no more than about 85 percent of the draining spike perimeter received therebetween.

DESCRIPTION OF THE PREFERRED EMBODIMENT

Figure 1:
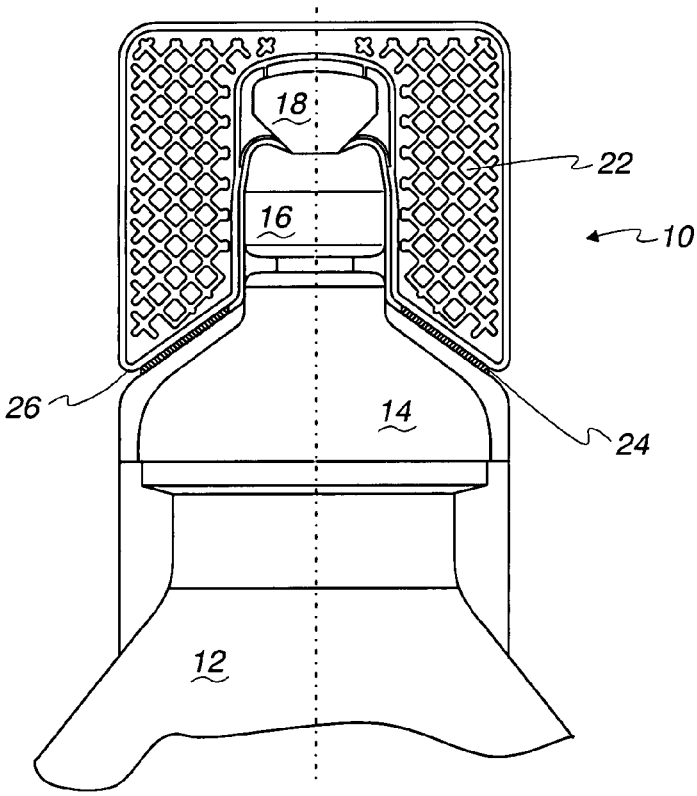
FIG. 1 is a front elevational view of an upper portion of a hermetically sealed thermoplastic container embodying the present invention.

The invention disclosed herein is, of course, susceptible of embodiment in many different forms. Shown in the drawings and described in detail hereinbelow are preferred embodiments of this invention. It is to be understood, however, that the present disclosure is an exemplification of the principles of the invention and is not to be taken as limiting.

The hermetically sealed thermoplastic container of the present invention is shown in the drawings and is described hereinbelow with reference to the container in a vertical upright position, and terms such as upper, lower, vertical, horizontal, and the like, when used, will be used with reference to that position.

In the interests of conciseness, the present drawings do not necessarily show features and details of the container that are known in the art and will be recognized as such by those skilled in the art. Detailed description of such features and details is not necessary for an understanding of the present invention.

Hermetically sealed thermoplastic containers embodying this invention can be readily fabricated from thermoplastic polymers such as polypropylene, high density polyethylene, low density polyethylene, and the like, utilizing the well-known blow-fill-seal technique shown and disclosed, for example, in U.S. Pat. No. 4,671,763 to Weiler. The containers so fabricated can have a wide variety of body shapes and capacities.

Figure 2:
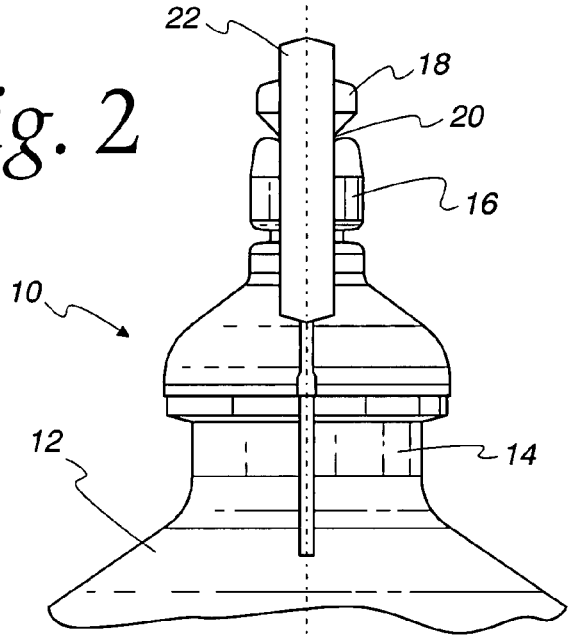
FIG. 2 is a side elevational view of the container portion shown in FIG. 1.

Referring now to FIGS. 1 and 2, the upper portion of hermetically sealed thermoplastic container 10 has a body portion 12, and a contoured neck portion 14 unitary with body portion 12. Neck portion 14 includes and terminates in a flexible enclosure 16 that defines a draining spike access aperture occluded by removable cap 18 which is unitary with enclosure 16 but is delineated therefrom by a frangible web 20 (FIG. 2). Grip tab 22 is unitary with removable cap 18 and is also connected to container 10 by frangible web portions 24 and 26 while cap 18 remains in place.

Figure 3:
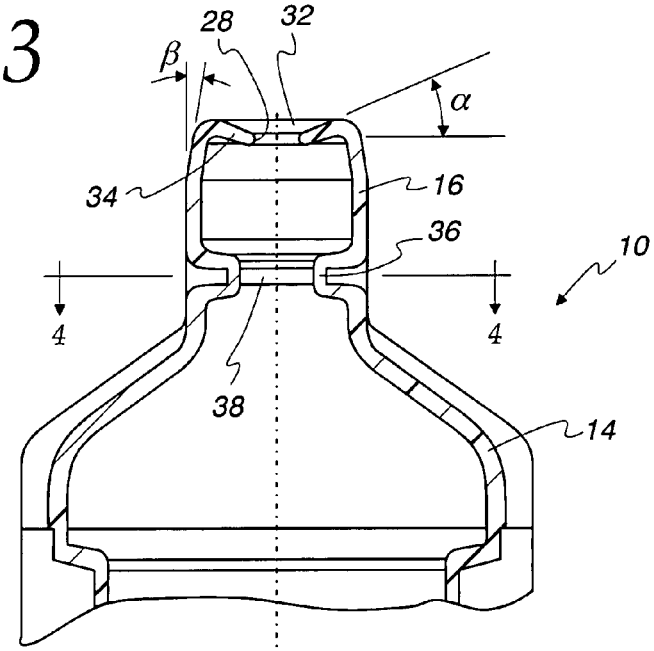
FIG. 3 is a sectional elevation of the container portion shown in FIG. 1 with removable cap removed and draining spike access aperture exposed.
Figure 5:
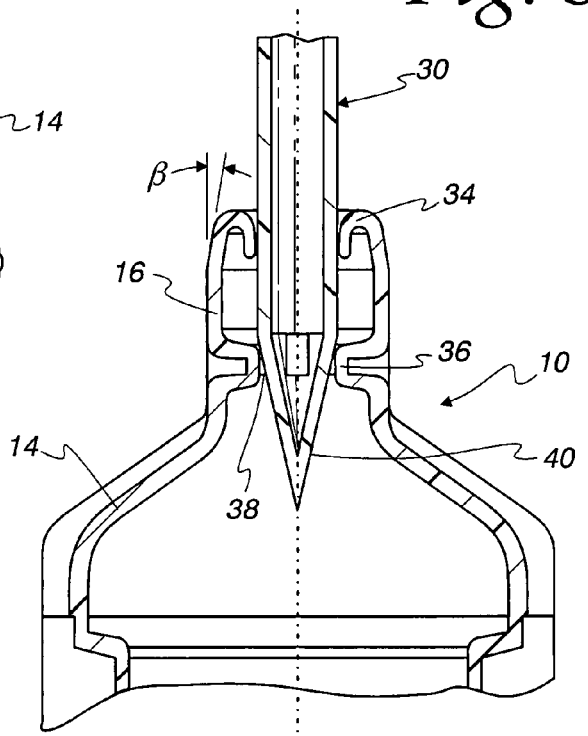
FIG. 5 is a sectional elevation similar to FIG. 3 and showing a draining spike entering the neck portion of the container.

When cap 18 has been removed as shown in FIG. 3, draining spike aperture 28, defined in the upper portion of flexible enclosure 16, is exposed and is ready to receive draining spike 30 as shown in FIG. 5. Aperture 28 is undersized with respect to the outside diameter of the draining spike so as to form a liquid-tight seal with the draining spike upon entry. The portion of flexible chamber 16 that immediately surrounds aperture 28 is sufficiently flexible to collapse inwardly about spike 30 to further enhance the seal therebetween. The configuration of flexible enclosure 16 is preferably bell-shaped as best seen in FIGS. 3 and 5, with the distal portion of flexible enclosure 16 tapered toward access aperture 28 at a taper angle β, preferably about 10 degrees. The shape of flexible enclosure 16 can vary as long as sufficient flexibility and elasticity is present for the upper portion thereof, and the edge defining the aperture, to curl or turn inwardly around spike 30 as it enters aperture 28. To that end, it is also preferred to provide a pilot depression 32 in upper wall 34 of flexible chamber 16. The portion of upper wall 34 that defines pilot depression 32 preferably tapers inwardly toward aperture 28 at a taper angle α as shown in FIG. 3. Taper angle α is preferably about 20 to about 30 degrees, more preferably about 20 degrees. The degree of taper in any given instance depends to some extent on the size of the container as well as on the outside diameter of the draining spike. In general, the larger the container, the greater the taper angle.

For proper positioning of the draining spike 30 in neck portion 14 of container 10, the position of draining spike 30 must be stabilized after the spike has penetrated flexible enclosure 16 of container 10. For that purpose there is provided a pair of inwardly extending flange segments 36 and 38 (FIGS. 3 and 4) that coact with the penetrating sharp end 40 of spike 30 (FIG. 5) and together serve as a draining spike stabilizer. Flange segments 36 and 38 are spaced from the spike access aperture by at least 1.5 draining spike outside diameters and are substantially coaxial with access aperture 28.

Figure 4:
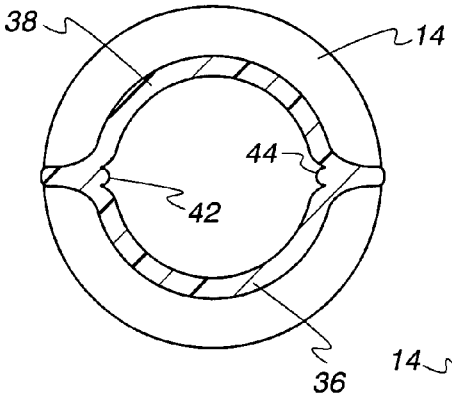
FIG. 4 is a sectional view taken along plane 4-4 in FIG. 3.

During the container fabrication process a slight thermoplastic material bulge is produced at the mold parting line as illustrated by bulges 42 and 44 in FIG. 4. If the inwardly extending flanges 36 and 38 were to surround the entire periphery of the distal end portion of draining spike 30, the bulges 42 and 44 would interfere with the proper positioning of draining spike 30. Additionally, insertion of a draining spike should not apply stress on the mold parting line in the container. The spike stabilizer does not provide a seal between the container and the draining spike. Accordingly, the opposed, inwardly extending flange segments are sized to contact no more than about 85 percent of the draining spike perimeter received therebetween, preferably about 60 to about 80 percent of the draining spike perimeter received therebetween. Each inwardly extending flange segment can be continuous or periodically interrupted, as desired. Alternatively, in lieu of inwardly extending opposed flange segments, spike stabilization can be achieved by providing a series of spaced, opposed protuberances bumps, and the like, that surround and engage the draining spike portion 40, and stabilize it in container neck portion 16.

In order to readily achieve the desired flexibility for flexible enclosure 16, the ratio of the inside diameter of the chamber defined by the flexible enclosure to the diameter of the draining spike access aperture preferably is in the range of about 1.5 to about 2.

The foregoing description and the drawings are illustrative and are not to be taken as limiting the present invention. Still other variations and rearrangements of the functional elements within the spirit and scope of this invention are possible and will readily present themselves to those skilled in the art.

We claim:

1. A hermetically sealed thermoplastic container having a body portion, a neck portion unitary with the body portion and a removable cap unitary with the neck portion but delineated therefrom by a frangible web;

the neck portion terminating in a flexible enclosure that defines a chamber having a draining spike access aperture defined by a recessed, inwardly collapsible edge portion but occluded by the removable cap and a draining spike stabilizer spaced from the spike access aperture and substantially coaxial therewith;

wherein said draining spike stabilizer comprises a pair of opposed inwardly extending flange segments adapted to receive a draining spike therebetween; and wherein said edge portion extends downwardly and inwardly towards said flange segments.

2. The hermetically sealed thermoplastic container in accordance with claim 1 wherein at least a portion of said flexible enclosure is inwardly collapsible.

3. The hermetically sealed thermoplastic container in accordance with claim 1 wherein the opposed flange segments are sized to contact no more than about 85 percent of a draining pike perimeter received therebetween.

4. The hermetically sealed thermoplastic container in accordance with claim 1 wherein the opposed flange segments are sized to contact about 60 to about 80 percent of a draining spike perimeter received therebetween.

5. The hermetically sealed thermoplastic container in accordance with claim 1 wherein the flexible enclosure defines a pilot depression around the spike access aperture.

6. The hermetically sealed thermoplastic container in accordance with claim 1 wherein the spike access aperture and the spike stabilizer are spaced from one another at a distance of at least 1.5 draining spike diameters.

7. The hermetically sealed thermoplastic container in accordance with claim 1 wherein the ratio of the inside diameter of the chamber defined by the flexible enclosure to the diameter of the draining spike access aperture is in the range of about 1.5 to about 2.

8. The hermetically sealed thermoplastic container in accordance with claim 1 wherein a distal portion of the flexible enclosure is tapered toward the access aperture.

* * * * *